US005647783A

United States Patent [19]

Nessel

[11] Patent Number: 5,647,783

[45] Date of Patent: Jul. 15, 1997

[54] HAND PROPULSION AID FOR SWIMMERS

[76] Inventor: Edward H. Nessel, 10 Irene Ct., Edison, N.J. 08820

[21] Appl. No.: 675,041

[22] Filed: Jul. 3, 1996

[51] Int. Cl.[6] ..... A63B 31/04

[52] U.S. Cl. ..... 441/58; 441/56

[58] Field of Search ..... 441/56–58; D21/237, D21/238

[56] References Cited

U.S. PATENT DOCUMENTS

| | | | |
|---|---|---|---|
| 1,371,708 | 3/1921 | Schreiner | 441/57 |
| 1,625,730 | 4/1927 | Lake | 441/57 |
| 3,174,167 | 3/1965 | Pauley | 441/57 |
| 4,964,824 | 10/1990 | Spencer et al. | 441/57 |

*Primary Examiner*—Sherman Basinger

[57] ABSTRACT

A hand propulsion aid for swimmers including a first planar sheet. The first planar sheet has a first exterior surface and a first interior surface essentially parallel with each other throughout at least the majority of their extent. The first sheet also has four fingers and a thumb extending forwardly therefrom with spaces between the fingers and the thumb. A second planar sheet is juxtapose the first planar sheet for coupling. The second planar sheet has a second exterior surface and a second interior surface essentially parallel with each other throughout at least the majority of their extent. The second sheet has four fingers and a thumb extending forwardly therefrom with spaces between the fingers and the thumb. Included are a plurality of slots formed within the second planar sheet. A strap formed of a tubular configuration is secured to the first interior surface of the first sheet for facilitating attachment to the hand of a swimmer. Lastly, a plurality of inserts, each having a raised bulb to engage one of the slots of the second sheet for attaching the insert to the second interior surface to form a web between each space of each planar sheet.

8 Claims, 3 Drawing Sheets

HAND PROPULSION AID FOR SWIMMERS

BACKGROUND OF THE INVENTION

1. Field of the Invention

The present invention relates to a new and improved hand propulsion aid for swimmers and, more particularly, pertains to assisting in the training of swimmers through a specially designed handpiece.

2. Description of the Prior Art

The use of devices for use by swimmers and other athletes to assist in training and to enhance performance is known in the prior art. More specifically, devices for use by swimmers and other athletes to assist in training and to enhance performance heretofore devised and utilized for the purpose of assisting swimmers and other athletes through supplemental devices utilized with various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for assisting in the training of swimmers through a specially designed handpiece. By way of example, U.S. Pat. No. 3,580,213 to Yuen discloses flotation paddles joined by a central shaft. U.S. Pat. No. 4,832,643 to Schools discloses a hand paddle for use by swimmers. U.S. Pat. No. 5,114,371 to Alonzo discloses a water paddle and flotation device for use by swimmers. U.S. Pat. No. 5,288,254 to Elson discloses a swimmer's hand paddle. U.S. Pat. No. 2,389,196 to Harmon discloses a swimming paddle. U.S. Pat. No. 2,313,979 to Tuma discloses a swimming appliance. U.S. Pat. No. 1,726,728 to Adams discloses a swimming glove. U.S. Pat. No. 3,328,812 to Berthiot discloses a swimmer's hand paddle. U.S. Patent Number Des. 262,477 to Lewis discloses swim paddles for arm attachment. U.S. Patent Number Des. 274,744 to Smithers discloses a strength-building swim paddle. Lastly, U.S. Pat. No. 5,516,319 to Nessel, issued May 14, 1996, disclosing an aid for swimmers of which the present application is an improvement.

In this respect, the hand propulsion aid for swimmers according to the present invention substantially departs from the conventional concepts and designs of the prior art, and in doing so provides an apparatus primarily developed for the purpose of assisting in the training of swimmers through a specially designed handpiece.

Therefore, it can be appreciated that there exists a continuing need for a new and improved hand propulsion aid for swimmers which can be used for assisting in the training of swimmers through a specially designed handpiece. In this regard, the present invention substantially fulfills this need.

SUMMARY OF THE INVENTION

In view of the foregoing disadvantages inherent in the known types of devices for use by swimmers and other athletes to assist in training and to enhance performance now present in the prior art, the present invention provides an improved hand propulsion aid for swimmers. As such, the general purpose of the present invention, which will be described subsequently in greater detail, is to provide a new and improved hand propulsion aid for swimmers and methods which have all the advantages of the prior art and none of the disadvantages.

To attain this, the present invention essentially comprises an hand propulsion aid for swimmers comprising a first planar sheet having a first exterior surface and a first interior surface essentially parallel with each other throughout at least the majority of their extent. The first sheet has four fingers and a thumb extending forwardly therefrom with spaces between the fingers and the thumb. A second planar sheet positionable juxtapose the first planar sheet for coupling therewith in a coextensive manner. The second planar sheet has a second exterior surface and a second interior surface essentially parallel with each other throughout at least the majority of their extent. The second sheet has four fingers and a thumb extending forwardly therefrom with spaces between the fingers and the thumb. A plurality of generally rectangular placeholders are formed within the second interior surface of the second planar sheet. Each placeholder is extended from a center extent thereof to be spaced below an edge of the four fingers and thumb of the second planar sheet. Each placeholder has a plurality of receiving grooves along a lateral edge thereof. A plurality of elongated slots are formed within the second planar sheet and proportionally space one from another and within one of the placeholders. One of each plurality of slots is below one of the spaces between the fingers and the thumb thereof. A plurality of long vertical rails formed on the second exterior surface of the second planar sheet and a plurality of short vertical rails formed on the second exterior surface of the second planar sheet. The plurality of long rails and the plurality of short rails of the second planar sheet project from a center extent and the finger and thumbs thereof. A strap formed of a tubular configuration is positioned on the first interior surface and secured with retainers for facilitating attachment to the hand of a swimmer. A plurality of generally rectangular inserts for forming a web between each space of the second planar sheet. Each of the inserts including an upper edge, a lower edge and side edges therebetween. The upper edge of each insert is concave while the lower edge has a key slot extending upwardly therefrom. Each insert has a raised bulb adjacent the lower edge for engaging one of the slots of the second sheet for attaching the insert to the second interior surface thereof. Each insert has a bump along one of the side edges for engaging one of the receiving grooves of the placeholder. Each insert is movable up and down when the first sheet is coupled to the second sheet for shortening or lengthening the spaces between the fingers and between the fingers and the thumb. Lastly, included are a plurality generally oblong recesses on the interior surface of the sheet for accommodating the fingers and thumb of the hand of a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis fox the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hand propulsion aid for swimmers which has all the advantages of the prior art devices for use by swimmers and other athletes to assist in training and to enhance performance and none of the disadvantages.

It is another object of the present invention to provide a new and improved hand propulsion aid for swimmers which may be easily and efficiently manufactured and marketed.

It is a further object of the present invention to provide a new and improved hand propulsion aid for swimmers which is of a durable and reliable construction.

An even further object of the present invention is to provide a new and improved hand propulsion aid for swimmers which is susceptible of a low cost of manufacture with regard to both materials and labor, and which accordingly is then susceptible of low prices of sale to the consuming public, thereby making such devices for use by swimmers and other athletes to assist in training and to enhance performance economically available to the buying public.

Still yet another object of the present invention is to provide a new and improved hand propulsion aid for swimmers which provides in the apparatuses and methods of the prior art some of the advantages thereof, while simultaneously overcoming some of the disadvantages normally associated therewith.

Even still another object of the present invention to assist in the training of swimmers through a specially designed handpiece.

Lastly, it is an object of the present invention to provide A hand propulsion aid for swimmers including a first planar sheet. The first planar sheet has a first exterior surface and a first interior surface essentially parallel with each other throughout at least the majority of their extent. The first sheet also has four fingers and a thumb extending forwardly therefrom with spaces between the fingers and the thumb. A second planar sheet is juxtapose the first planar sheet for coupling. The second planar sheet has a second exterior surface and a second interior surface essentially parallel with each other throughout at least the majority of their extent. The second sheet has four fingers and a thumb extending forwardly therefrom with spaces between the fingers and the thumb. Included are a plurality of slots formed within the second planar sheet. A strap formed of a tubular configuration is secured to the first interior surface of the first sheet for facilitating attachment to the hand of a swimmer. Lastly, a plurality of inserts, each having a raised bulb to engage one of the slots of the second sheet for attaching the insert to the second interior surface to form a web between each space of each planar sheet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
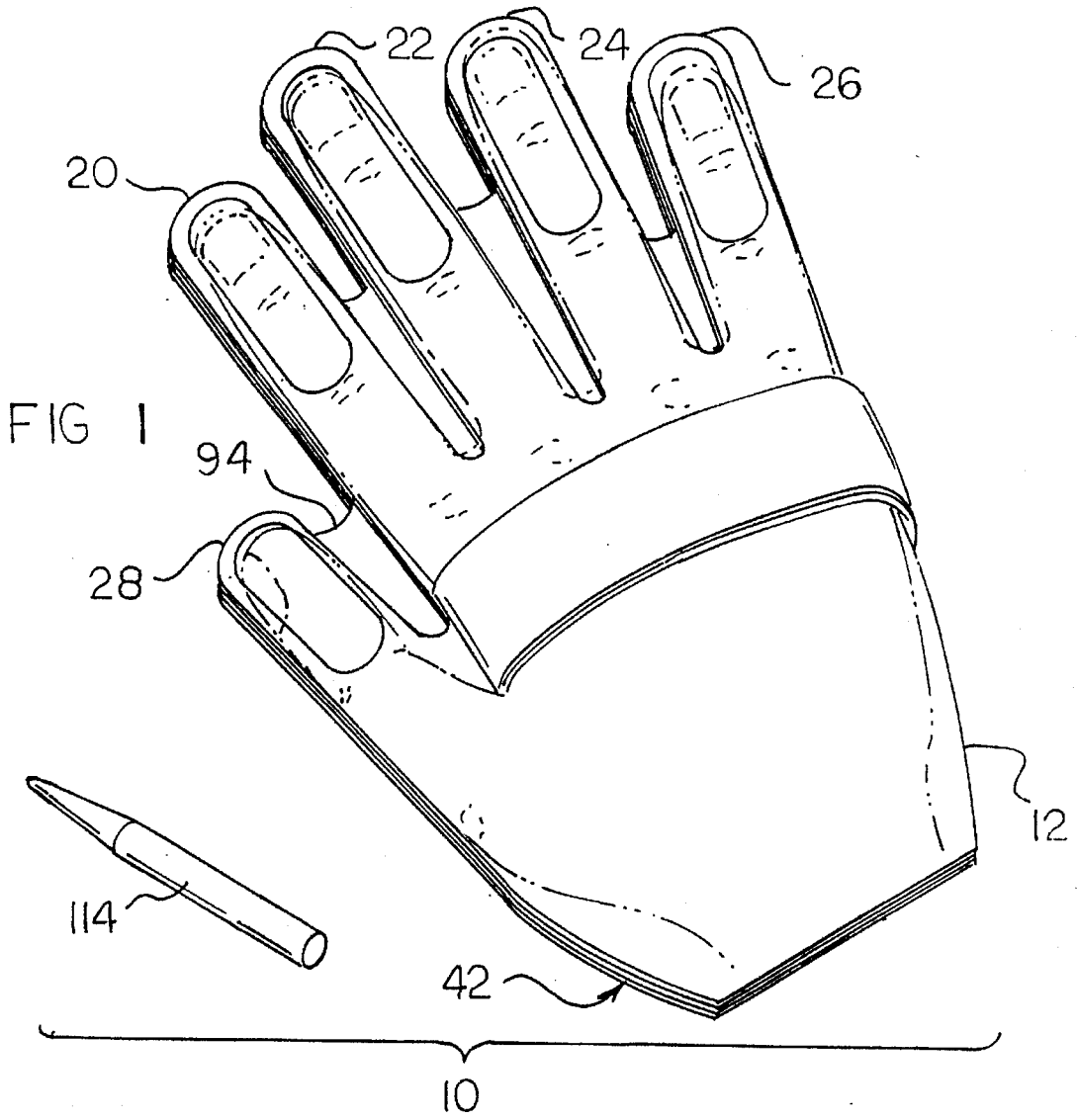
FIG. 1 is a front elevational view of the preferred embodiment of the new and improved hand propulsion aid for swimmers constructed in accordance with the principles of the present invention.

With reference now to the drawings, and in particular to FIG. 1 thereof, the preferred embodiment of the new and improved hand propulsion aid for swimmers embodying the principles and concepts of the present invention and generally designated by the reference numeral 10 will be described.

The present invention, the new and improved hand propulsion aid for swimmers, is a system 10 comprised of a plurality of components. In their broadest context, the components include a pair of planar sheets, straps and insert between the fingers. Each of the individual components is specifically configured and correlated one with respect to the other so as to attain the desired objectives.

Figure 2:
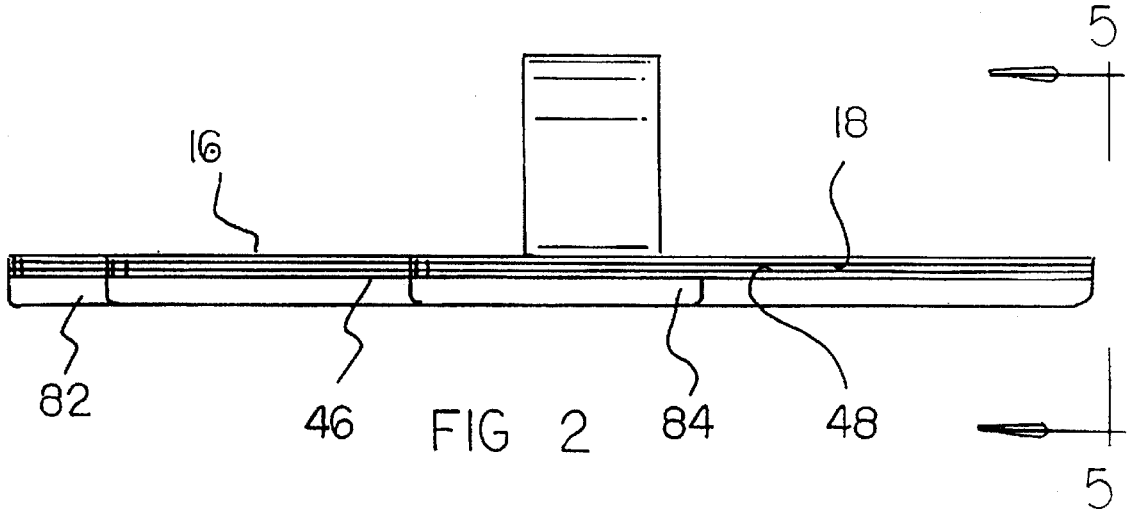
FIG. 2 is a side elevational view of the device shown in FIG. 1.

More specifically, the aid 10 of the present invention has as one of its basic components a first planar sheet 12. Such sheet has a first exterior surface 16 and a first interior surface 18. As seen in FIG. 2, such surfaces are essentially parallel with respect to each other throughout at least a majority of their extent. The first sheet has four fingers 20, 22, 24, 26 and a thumb 28. Such fingers and thumb extend forwardly from the major portion of the first sheet. Spaces 30, 32, 34 and 36 are located between the fingers and the thumb.

Figure 3:
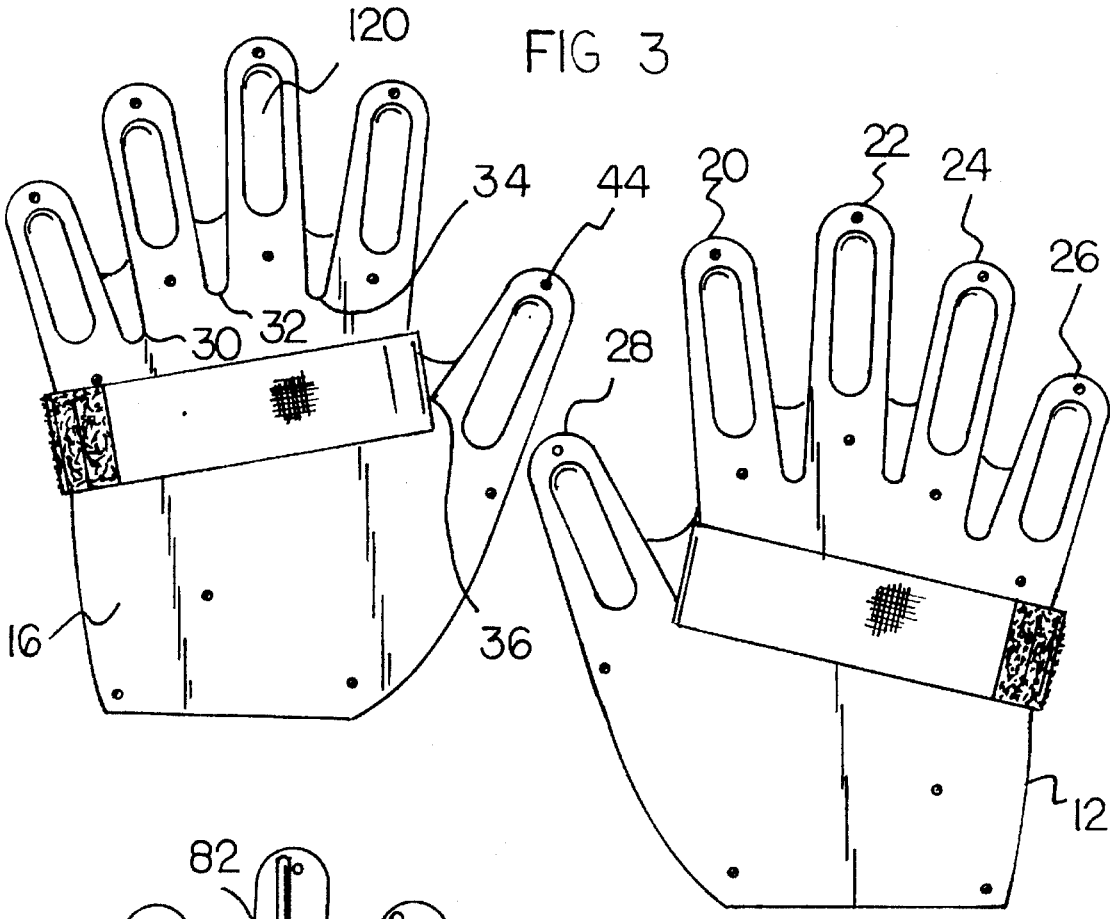
FIG. 3 is a top elevational view of a left and right hand the device shown in FIGS. 1.

Included as the second basic component is a second planar sheet 42 positioned juxtapose the first planar sheet 12. The second planar sheet will couple with the first planar sheet in a coextensive manner. The sheets are coupled with a plurality of screws 44 as seen in FIG. 3. The second planar sheet has a second exterior surface 46 and a second interior surface 48 essentially parallel with each other throughout at least the majority of their extent. The second sheet has four fingers 50, 52, 54, 56 and a thumb 58. Such fingers and thumb extend forwardly from the major portion of the second sheet. Spaces 60, 62, 64 and 66 are located between the fingers and the thumb.

Figure 4:
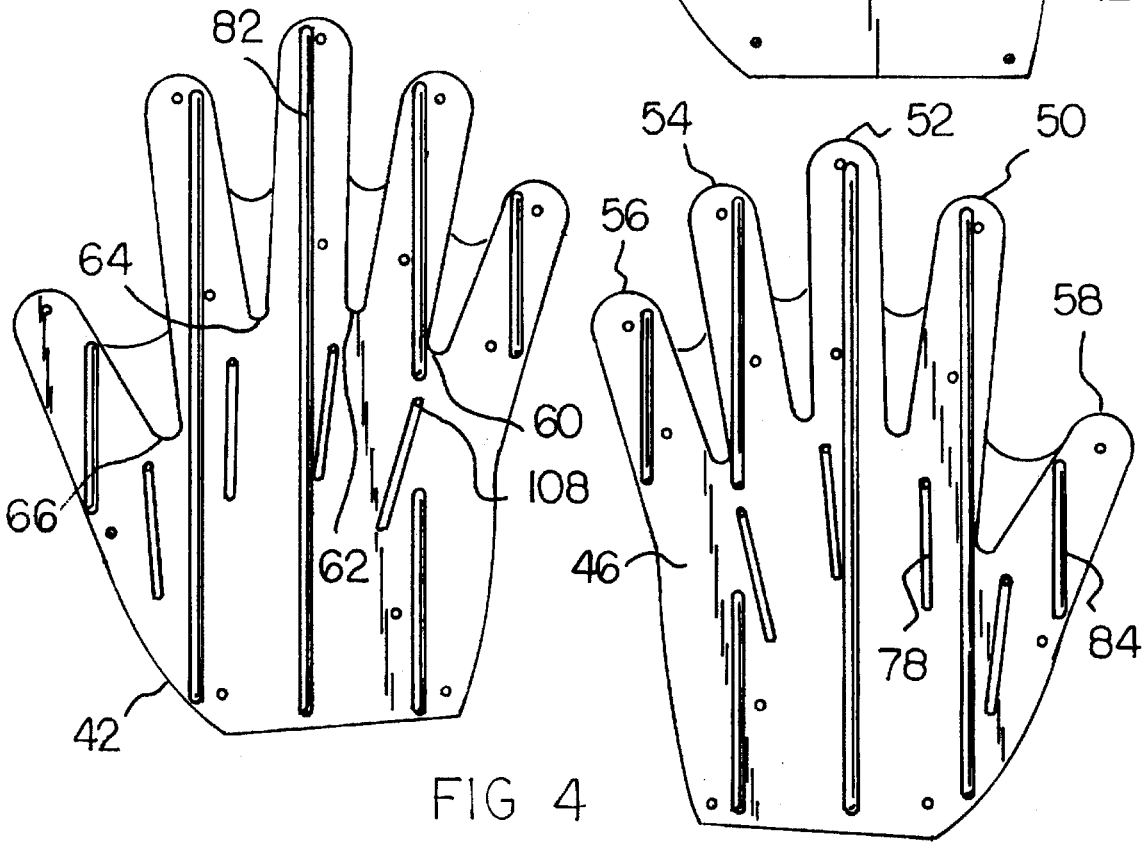
FIG. 4 is a bottom elevational view of the left and right hand of the device shown in FIG. 3.

As best illustrated in FIGS. 3 and 4, two of the coupled planar sheets are preferably utilized. One coupled planar sheet is used for each hand of a swimmer utilizing the device as an aid. Their constructions are identical except that they are mirror images with respect to each other.

Figure 6:
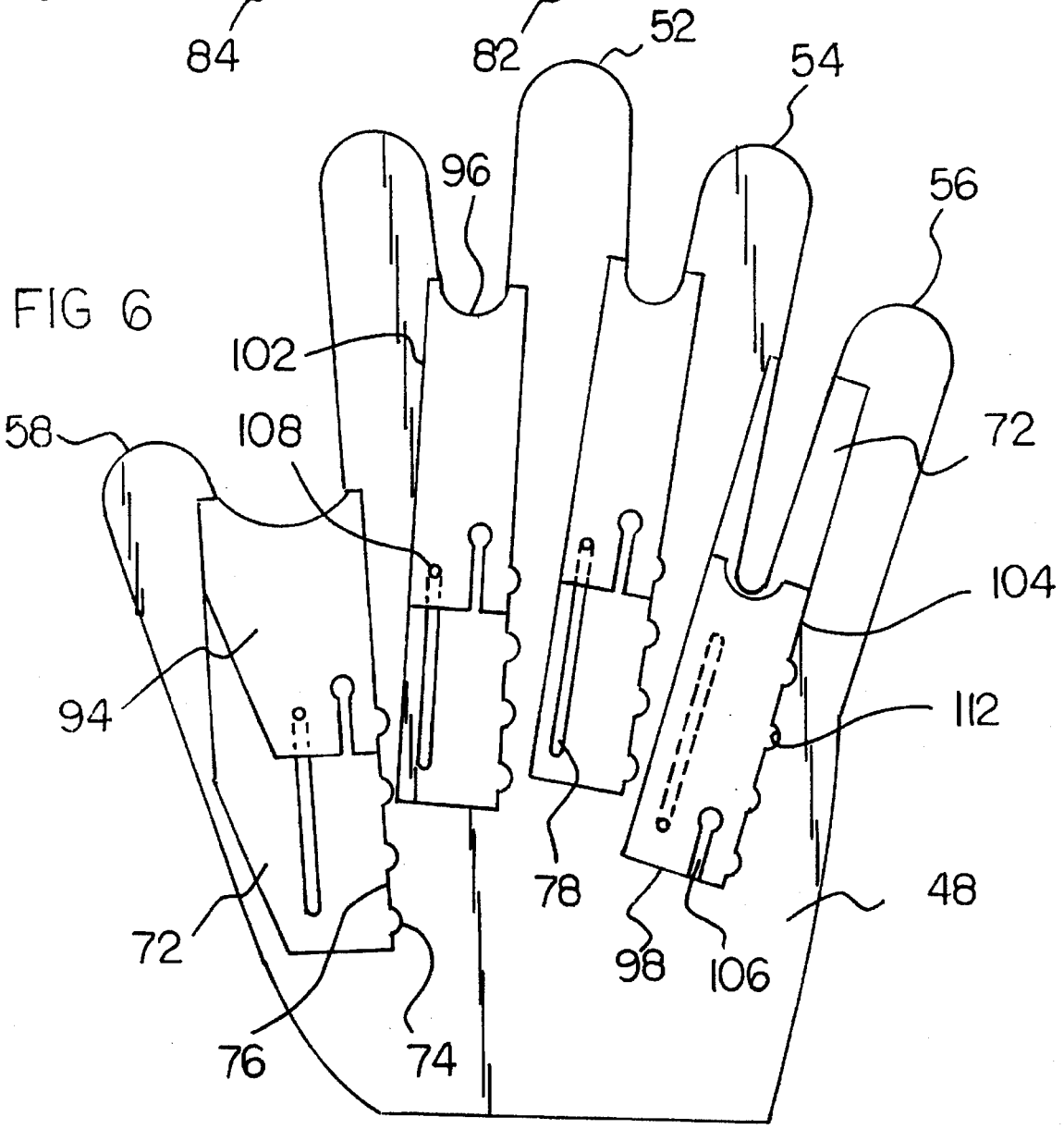
FIG. 6 is a cross sectional view the device taken along line 6—6 of FIG. 5.

Also, a plurality of generally rectangular placeholders 72 are formed within the second interior surface of the second planar sheet, as shown in FIG. 6. Each placeholder extends from a center extent thereof to end at a position just below an edge of the four fingers and thumb of the second planar sheet. Each placeholder has a plurality of receiving grooves 74 along a vertical edge 76.

Additionally, a plurality of elongated slots 78 are formed within the second planar sheet. As shown in FIG. 4, the slots are proportionally spaced one from another. In viewing the slots from the cross sectional view of FIG. 6, one of each slot appears to be through one of each placeholders. One of each plurality of slots is positioned below one of the spaces between the fingers and the thumb.

Figure 5:
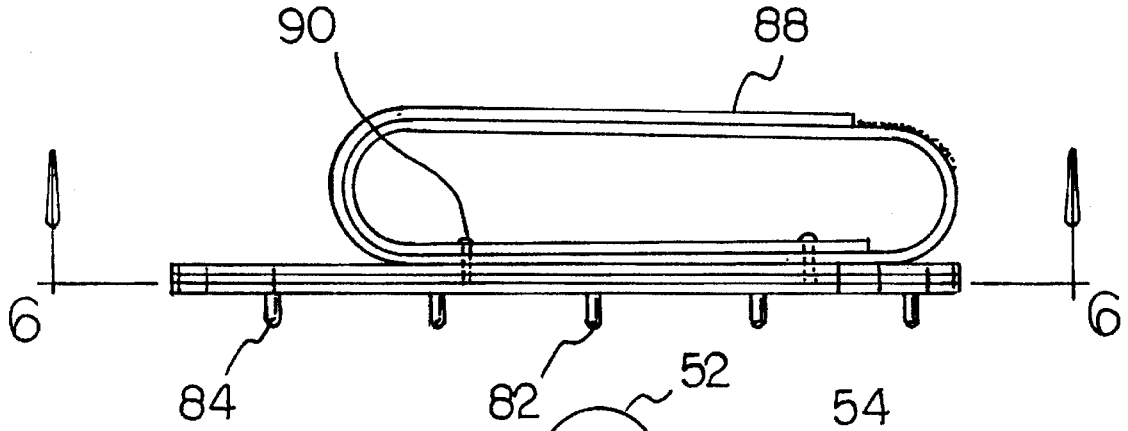
FIG. 5 is a rear view of the device taken along line 5—5 of FIG. 2.

Next to be provided on the second planar sheet are a plurality of long vertical rails 82. The long rails are formed on the second exterior surface of the second planar sheet. A plurality of short vertical rails 84 are also formed on the second exterior surface of the second planar sheet. The plurality of long rails and the plurality of short rails of the second planar sheet, as shown in FIG. 5, project from a center extent and the finger and thumb. Each rail is vertical and unaligned with the fingers and thumb of the second planar sheet.

Supporting the planar sheets, having been coupled, to the hand of a user is a strap 88. The strap is formed of a tubular configuration positioned on the first interior surface and secured with retainers 90 for facilitating attachment to the hand of a swimmer. The function of this arrangement is to secrue the first and second planar sheet to the hand or hands of the swimmer.

Included are a plurality of generally rectangular inserts 94. The inserts form a web between each space of the second planar sheet as seen in FIG. 1. Each of the inserts include an upper edge 96, a lower edge 98 and side edges 102 and 104. The upper edge of each insert is concave. The lower edge has a key slot 106 that extends upwardly from the lower edge. Each insert has a raised bulb 108 adjacent the lower edge. The raised bulbs of each insert will engage one of the slots of the second sheet and protrude a minor distance from the second exterior surface. When the raised bulb of the insert couples with the slot the insert is attached to the second interior surface. Each insert has a bump 112 along one of the side edges 104. The bump engags one of the receiving grooves 74 of the placeholder when the insert is positioned within the placeholder. Each insert can be movable up and down within the slot, when the first sheet is coupled to the second sheet. Such movement of each insert will cause the space between the fingers and the thumb to be shorten or lengthen as desired by the user.

A stylus 114 is provided. The stylus, as shown in FIG. 1, engages the raised bulbs for pushing the insert up and down. Each time the insert is pushed, a clicking is heard when it engages one of the receiving grooves of the respective placeholder. If the stylus becomes inoperable or lost, for adjustment purposes, the user may use the raised bulbs to push the inserts upward. To lower the inserts, for adjustment without the stylus, the user needs only press down on the upper edge of the inserts.

Finally, a plurality of generally oblong recesss 120 are on the interior surface of the first sheet 12. As seen in FIG. 1, the recesses will accommodate the fingers and thumb of the hand of a user. The recesses are fabricated within the first planar sheet.

The present invention comprises paddles which are placed on the hands to train competitive swimmers and others in the correct technique by their utilization.

The paddles are made of plastic and are thin molded impressions of the hands. The inserts with the raised bulb are made of plastic. Contrary to popular belief, the fingers are spread apart slightly, rather than cupped, and railes are added in some units to reduce water resistance as the hand enters the water without decreasing the effectiveness. They fit over the palm and front of the fingers, with a strap around the back of the hand keep them in place. To improve the feel at the fingertips, recesses are molded into the first exterior surface of the first planar sheet in that area. The movable inserts that provide for movable webing between the fingers and between the finger and thumb increase water resistance that can aid in water pull with the swimmers stroke. All paddles could be made in several sizes.

It has been determined that hand and finger positioning is very important to competitive swimmers. As stated, the fingers are slightly spread apart. The present invention serves to teach how it is done. The present invention also has a much better feel than other similar devices when they are being used because they are literally molded to the shape of the hands.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new-and improved hand propulsion aid for swimmers comprising, in combination:

a first planar sheet having a first exterior surface and a first interior surface essentially parallel with each other throughout at least the majority of their extent, the first sheet having four fingers and a thumb extending forwardly therefrom with spaces between the fingers and the thumb;

a second planar sheet positionable juxtapose the first planar sheet for coupling therewith in a coextensive manner, the second planar sheet having a second exterior surface and a second interior surface essentially parallel with each other throughout at least the majority of their extent, the second sheet having four fingers and a thumb extending forwardly therefrom with spaces between the fingers and the thumb;

a plurality of generally rectangular placeholders being formed within the second interior surface of the second planar sheet, each placeholder being extended from a center extent thereof to be spaced below an edge of the four fingers and thumb of the second planar sheet, each placeholder having a plurality of receiving grooves along a lateral edge thereof;

a plurality of elongated slots formed within the second planar sheet and proportionally spaced one from another and within one of the placeholders, one of each plurality of slots being below one of the spaces between the fingers and the thumb thereof;

a plurality of long vertical rails formed on the second exterior surface of the second planar sheet and a plurality of short vertical rails formed on the second exterior surface of the second planar sheet, the plurality of long rails and the plurality of short rails of the second planar sheet project from a center extent and the finger and thumbs thereof;

a strap formed of a tubular configuration positioned on the first interior surface and secured with retainers for facilitating attachment to the hand of a swimmer;

a plurality of generally rectangular inserts for forming a web between each space of the second planar sheet, each of the inserts including an upper edge, a lower edge and side edges therebetween, the upper edge of each insert being concave while the lower edge having a key slot extending upwardly therefrom, each insert having a raised bulb adjacent the lower edge for engaging one of the slots of the second sheet for attaching the insert to the second interior surface thereof, each insert having a bump along one of the side edges for engaging one of the receiving grooves of the placeholder, each insert being movable up and down when the first sheet being coupled to the second sheet for shortening or lengthening the spaces between the fingers and between the fingers and the thumb; and a plurality of generally oblong recesss are on the interior surface of the first planar sheet for accommodating the fingers and thumb of the hand of a user.

2. A hand propulsion aid for swimmers comprising:

a first planar sheet having a first exterior surface and a first interior surface essentially parallel with each other throughout at least the majority of their extent, the first sheet having four fingers and a thumb extending forwardly therefrom with spaces between the fingers and the thumb;

a second planar sheet positionable juxtapose the first planar sheet for coupling therewith, the second planar sheet having a second exterior surface and a second interior surface essentially parallel with each other throughout at least the majority of their extent, the second sheet having four fingers and a thumb extending forwardly therefrom with spaces between the fingers and the thumb;

a plurality of elongated slots formed within the second planar sheet, one of each plurality of slots being below one of each of the spaces;

a trap formed of a tubular configuration secured onto the first interior surface for facilitating attachment to the hand of a swimmer; and a plurality of inserts with each having a raised bulb adjacent a lower edge for engaging one of the slots of the second sheet for attaching the insert to the second interior surface thereof and for forming a web between each space of the second planar sheet coupled with the first planar sheet.

3. The hand propulsion aid for swimmers as set forth in claim 2, wherein the second planer sheet further comprising a plurality of generally rectangular placeholders being formed within the second interior surface thereof.

4. The hand propulsion aid for swimmers as set forth in claim 3, wherein each placeholder being extended from a center extent thereof to be spaced below an edge of the four fingers and thumb of the second planar sheet, each placeholder having a plurality of receiving grooves along a lateral edge.

5. The hand propulsion aid for swimmers as set forth in claim 4, wherein each of the inserts being generally rectangular and further including an upper edge and side edges therebetween.

6. The hand propulsion aid for swimmers as set forth in claim 5, wherein the upper edge of each insert being concave while the lower edge having a key slot extending upwardly therefrom, each insert having a bump along one of the side edges for engaging one of the receiving grooves of the placeholder, each insert being movable up and down when the first sheet being coupled to the second sheet for shortening or lengthening the spaces between the fingers and between the fingers and the thumb.

7. The hand propulsion aid for swimmers as set forth in claim 2, wherein the second planar sheet further including:

a plurality of long vertical rails formed on the second exterior surface of the second planar sheet, the plurality of long rails project from a center extent and the finger and thumb; and a plurality of short vertical rails formed on the second exterior surface of the second planar sheet, the plurality of short rails of the second planar sheet project from a center extent and the finger and thumb.

8. The hand propulsion aid for swimmers as set forth in claim 2, wherein the first planar sheet having a plurality generally oblong recess on the interior surface for accommodating the fingers and thumb of the hand of a user.

* * * * *